United States Patent [19]

Allen et al.

[11] Patent Number: 4,730,531

[45] Date of Patent: Mar. 15, 1988

[54] KETTLEDRUM

[76] Inventors: Barbara A. Allen; Rebecca Kite, both of P.O. Box 1954, 4015 N. Louden Rd., Bloomington, Ind. 47402

[21] Appl. No.: 927,852

[22] Filed: Nov. 6, 1986

Related U.S. Application Data

[63] Continuation-in-part of Ser. No. 667,217, Nov. 1, 1984, Pat. No. 4,674,390, which is a continuation-in-part of Ser. No. 617,747, Jun. 6, 1984, Pat. No. 4,635,524.

[51] Int. Cl.[4] ..... G10D 13/04

[52] U.S. Cl. ..... 84/419; 84/411 A

[58] Field of Search ..... 84/412, 415, 419, 420, 84/421, 411 A

[56] References Cited

U.S. PATENT DOCUMENTS

| | | | |
|---|---|---|---|
| Re. 16,226 | 12/1925 | Strupe . | |
| 355,970 | 1/1887 | Boulanger . | |
| 355,971 | 1/1887 | Boulanger . | |
| 874,050 | 12/1907 | Bower . | |
| 1,356,193 | 10/1920 | Danly . | |
| 1,391,437 | 9/1921 | Wiedoeft . | |
| 1,469,197 | 9/1923 | Strupe . | |
| 1,561,789 | 11/1925 | Ludwig et al. . | |
| 1,561,790 | 11/1925 | Ludwig et al. . | |
| 1,565,329 | 12/1925 | Robison . | |
| 1,755,569 | 4/1930 | Strupe | 84/419 |
| 1,845,625 | 2/1932 | Robison . | |
| 1,916,123 | 6/1933 | Greenleaf . | |
| 2,070,082 | 2/1937 | Horak | 84/419 |
| 2,074,194 | 3/1937 | Strupe | 84/419 |
| 2,150,981 | 3/1939 | Ludwig | 84/419 |
| 2,205,593 | 6/1940 | Jeffries | 84/419 |
| 2,259,268 | 10/1941 | Robison . | |
| 2,261,119 | 11/1941 | Ludwig et al. | 84/421 |
| 2,276,846 | 3/1942 | Jeffries | 84/419 |
| 2,502,733 | 4/1950 | Ludwig | 84/418 |
| 2,568,504 | 9/1951 | Ludwig | 84/419 |
| 2,586,476 | 2/1952 | Murbach | 84/419 |
| 2,587,310 | 2/1952 | Goodman | 84/419 |
| 2,729,133 | 1/1956 | Ludwig | 84/419 |
| 3,021,743 | 2/1962 | Ludwig | 84/419 |
| 3,163,075 | 12/1964 | Toperzer, Jr. | 84/419 |
| 3,163,076 | 12/1964 | White | 84/419 |
| 3,279,299 | 10/1966 | Murbach | 84/419 |
| 3,376,777 | 4/1968 | Becker-Ehmck | 84/419 |
| 3,608,418 | 9/1971 | Chaffee et al. | 84/419 |
| 3,646,843 | 3/1972 | Kregal | 84/419 |
| 3,701,834 | 10/1972 | Rubio | 84/419 |
| 3,747,463 | 7/1973 | Hinger | 84/419 |
| 4,056,998 | 11/1977 | Rampton | 84/419 |
| 4,188,852 | 2/1980 | Light | 84/411 A |
| 4,278,003 | 7/1981 | Hanson | 84/411 A |
| 4,312,259 | 1/1982 | Henrit | 84/419 X |
| 4,635,524 | 1/1987 | Allen et al. | 84/419 |

FOREIGN PATENT DOCUMENTS

| | | |
|---|---|---|
| 87629 | 3/1922 | Austria . |
| 12816 | 4/1881 | Fed. Rep. of Germany . |
| 15199 | 10/1881 | Fed. Rep. of Germany . |
| 82118 | 7/1895 | Fed. Rep. of Germany . |
| 407916 | 1/1925 | Fed. Rep. of Germany . |
| 607449 | 12/1934 | Fed. Rep. of Germany . |
| 1024321 | 2/1958 | Fed. Rep. of Germany . |
| 923594 | 2/1947 | France . |
| 458236 | 7/1950 | Italy . |
| 2310 | 10/1856 | United Kingdom . |
| 590803 | 7/1947 | United Kingdom . |

*Primary Examiner*—Benjamin R. Fuller
*Attorney, Agent, or Firm*—Barnes & Thornburg

[57] ABSTRACT

A percussion instrument includes a body, a percussion head carried by the body, and a variable tension-exerting mechanism to vary the pitch of sound produced when the head is struck. An actuating mechanism for actuating the variable tension-exerting mechanism includes a pedal having a generally planar user-engageable top surface, and a bottom surface. The bottom surface includes a pivot. A lever is pivotably mounted on the pivot and includes a portion extending toward the heel of the pedal and accessible to the user's foot along one side of the heel while the user's foot is positioned on the top surface of the pedal. The lever also includes a portion which extends to the toe of the pedal and provides an engaging mechansim. A positioning mechanism on the percussion instrument is selectively engageable by the engaging mechanisms on the lever for selectively fixing the position of the pedal.

4 Claims, 5 Drawing Figures

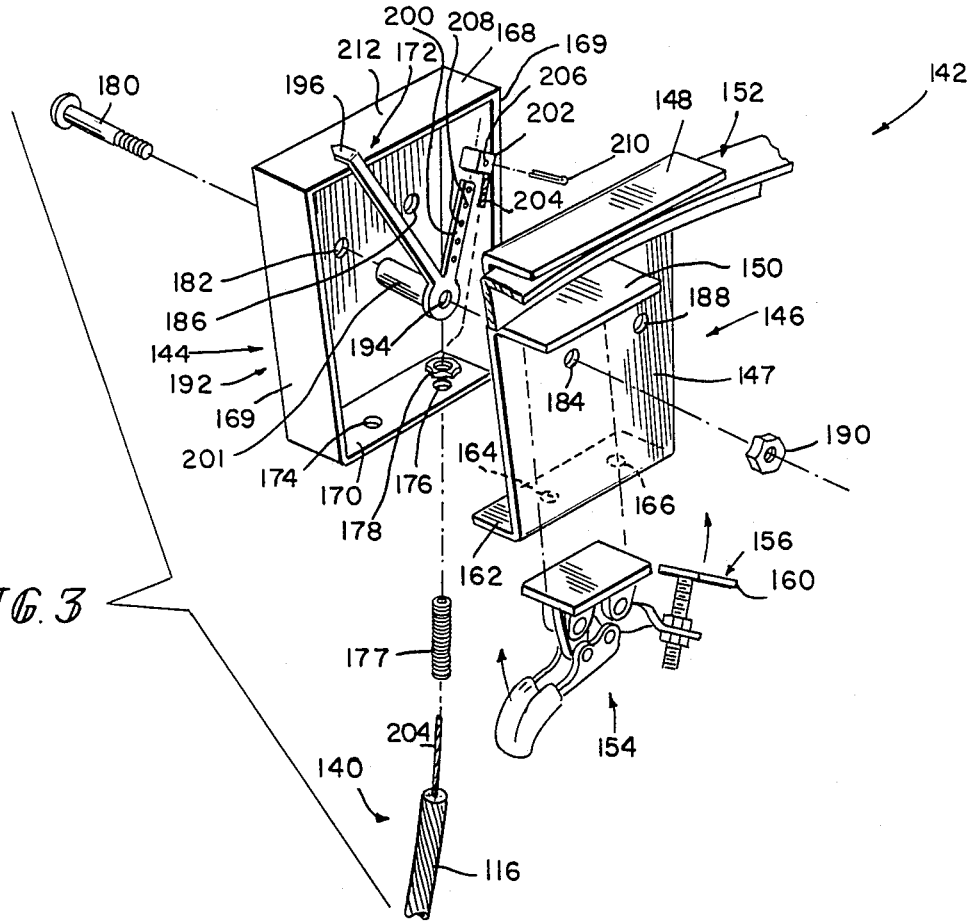
FIG. 3
FIG. 5
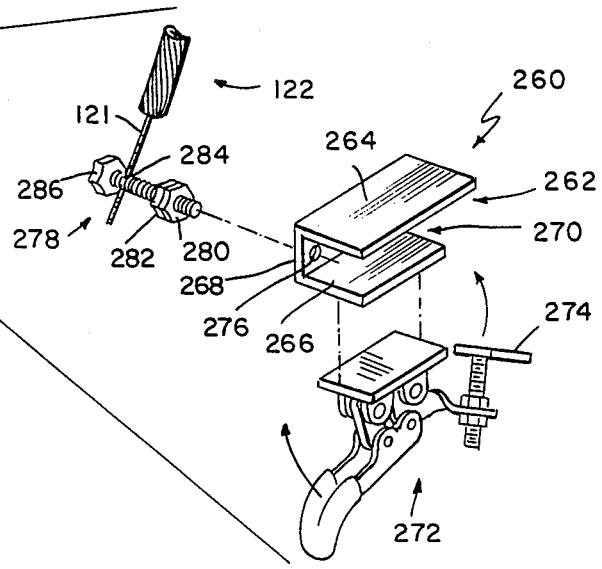

KETTLEDRUM

This is a continuation-in-part of our U.S. Ser. No. 667,217 filed Nov. 1, 1984, now U.S. Pat. No. 4,674,390, which is a continuation-in-part of our U.S. Ser. No. 617,747 filed June 6, 1984, now U.S. Pat. No. 4,635,524. Both of those applications are incorporated herein by reference. Both are assigned to the same assignee as the present application.

This invention relates to improvements in support bases and tensioning and pedal mechanisms of the type disclosed in our U.S. Ser. No. 667,217 and our U.S. Ser. No. 617,747.

According to one aspect of the invention, a percussion instrument comprises a body member, means for supporting the body member, a percussion head carried by the body member, tensioning rods, means for operatively coupling the tensioning rods to the percussion head and a master tensioning member for tensioning the percussion head. The master tensioning member includes a central portion and radially outer portions. Means are provided for coupling the tensioning rods to the radially outer portions, for mounting the master tensioning member for movement relative to the means for supporting the body member, and for moving the master tensioning member relative to the body member to tune the tension on the portion of the percussion head stretched across the body member selectively. The means for moving the master tensioning member comprises a pedal, a first lever for engaging the pedal, a shaft, means for rotatably mounting the shaft on the means for supporting the body member, means for mounting the first lever to the shaft to turn the shaft in response to movement of the first lever, a second lever, and means for pivotally mounting the second lever from the means for supporting the body member. The second lever includes means for engaging the master tensioning member such that pivotal movement of the second lever moves the master tensioning member. The instrument further includes a third lever, means for pivotally coupling the third lever to the second lever intermediate the ends of the second lever and intermediate the ends of the third lever, and a linkage for coupling the shaft to the third lever such that movement of the first lever causes a corresponding movement of the master tensioning member.

According to an illustrative embodiment of this aspect of the invention, a tuning gauge comprises a gauge face, an indicator, means for relatively movably mounting the indicator and the gauge face, and means for mounting the gauge on the percussion instrument. A first end of a cable sheath is mounted stationarily relative to one of the gauge face and indicator. The second end of the cable sheath is mounted stationarily relative to one of the master tensioning member and the means for supporting the body member. The first end of the sheathed cable is mounted stationarily relative to the other of the gauge face and indicator, and the second end of the sheathed cable is mounted stationarily relative to the other of the master tensioning member and the means for supporting the body member. Relative movement of the master tensioning member and means for supporting the body member thus results in relative movement of the indicator and gauge face.

According to another aspect of the invention, a percussion instrument comprises a body member, means for supporting the body member, a percussion head carried by the body member, tensioning rods, means for operatively coupling the tensioning rods to the percussion head, and a master tensioning member for tensioning the percussion head. The master tensioning member has a central portion and radially outer portions. Means are provided for coupling the tensioning rods to the radially outer portions, and for mounting the master tensioning member for movement relative to the means for supporting the body member. Means are provided for moving the master tensioning member relative to the means for supporting the body member to tune the tension on the portion of the percussion head stretched across the body member selectively. A tuning gauge comprises a gauge face and an indicator, means for relatively movably mounting the indicator and the gauge face, a sheathed cable, means for mounting a first end of the cable sheath stationarily relative to one of the gauge face and indicator, means for mounting the second end of the cable sheath stationarily relative to one of the master tensioning member and the means for supporting the body member, means for mounting the first end of the cable stationarily relative to the other of the gauge face and indicator, and means for mounting the second end of the cable stationarily relative to the other of the master tensioning member and the means for supporting the body member. Relative movement of the master tensioning member and means for supporting the body member thereby results in relative movement of the indicator and gauge face.

According to another aspect of the invention, a percussion instrument comprises a body member, a percussion head carried by the body member, a variable tension-exerting means for exerting variable tension on the head to vary the pitch of sound produced when the head is struck and an actuating means for actuating the variable tension-exerting means. The actuating means comprises a pedal having a generally planar user-engageable top surface and a bottom surface on the side of the pedal opposite the top surface. The bottom surface includes means providing a pivot, a lever pivotally mounted on the pivot and including a portion extending toward the heel of the pedal and accessible by the foot of the user of the pedal along one side of the heel thereof while the user's foot is positioned on the top surface. The lever also includes a portion extending to the toe of the pedal and providing an engaging means. The instrument also includes a positioning means selectively engageable with the engaging means for fixing the position of the pedal.

The invention may best be understood by referring to the following description and accompanying drawings which illustrate the invention. In the drawings:

FIG. 3 is a fragmentary perspective view showing certain details of a tuning gauge for a kettledrum;

Figures 1, 4:
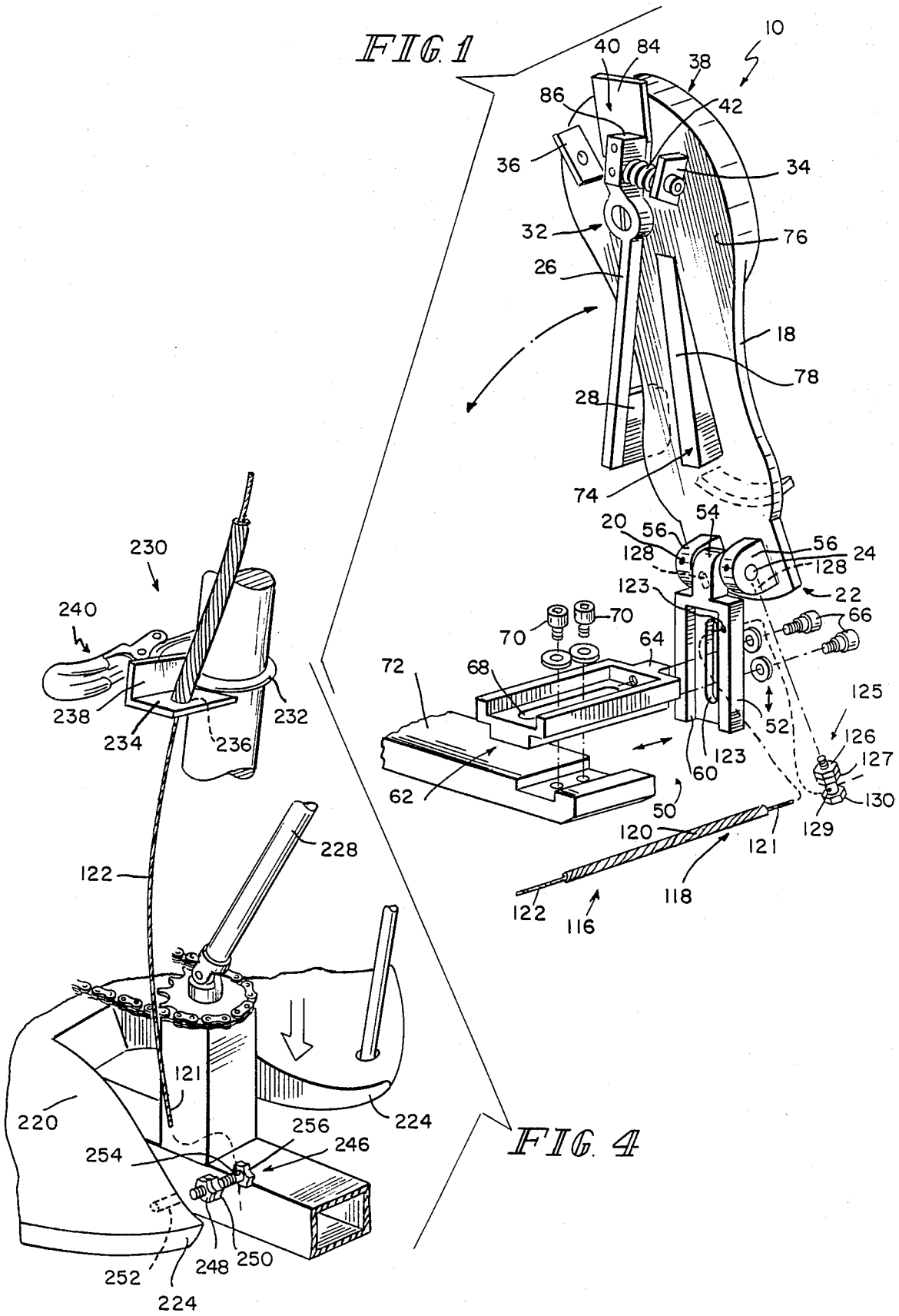
FIG. 1 is an exploded fragmentary perspective view showing certain details of the tuning mechanism of a kettledrum of the type described in the above-mentioned co-pending U.S. patent applications.

FIG. 4 is a fragmentary perspective view showing certain details of a tuning mechanism of a kettledrum of the type described in in the above-mentioned U.S. Ser. No. 667,217; and, FIG. 5 is a fragmentary perspective view showing certain details of a universal tuning gauge for a kettledrum.

A foot actuable pedal 10 for actuating the variable tension exerting means 12 of a percussion instrument, such as a kettledrum, is shown in FIG. 1.

Pedal 10 is mounted on a movable pedal mechanism which permits the user to adjust the location of the pedal 10 relative to the frame of the drum. Pedal 10 provides a user-engageable top surface 18. A heel-actuable lever 26 includes a heel-engageable portion 28 and a lever portion which extends under the pedal 10 and is pivotally mounted at 32 to the underside of the pedal 10. Stops 34, 36 extend forward from pivot 32 and diverge from each other toward the toe end 38 of the pedal 10 to define between them a somewhat pie-shaped, or V-shaped, sector 40. The pedal 10 is configured so that it can be operated by the player's right foot or left foot. Levers 26 having both right side- and left side-actuable configurations are provided, but either configuration of lever 26 can be attached at pivot 32 to the single-configuration pedal 10. If a right side-actuable lever 26 is chosen, then a compression spring 42 is placed between stop 34 and lever 26 between pivot 32 and the toe end 38 of pedal 10 to restore lever 26 to its rest position when it is forced from the rest position by the player's heel pressure against the heel-engageable portion 28. If a left side-actuable lever 26 is chosen, then compression spring 42 is placed between stop 36 and lever 26 between pivot 32 and toe end 38 to provide the restoring force.

A mechanism 50 is provided for enabling the user to change the location of the pedal 10. The user can change both the vertical and horizontal locations of the pedal 10 to place the pedal 10 in a position most comfortable for the user. The mechanism 50 includes a vertically extending member 52 which includes a knuckle 54 at its upper end. Knuckle 54 is positioned between the knuckles 56 provided on the underside of pedal 10 at its heel end 22. The knuckles 54, 56 are provided with aligned openings through which a rod 24 extends. The bolts 20 fix the position of the rod 24 in the openings in knuckles 56 and thereby fix the pedal 10 pivotally on member 52. Member 52 includes a slot 60 which extends substantially its full length. A horizontally extending member 62 has an end portion 64 adapted for engagement in the slot 60. Bolts 66 with washers are threaded into end portion 64 to fix the position of vertically extending member 52 relative to horizontally extending member 62. Horizontally extending member 62 is provided with a slot 68 which extends for substantially the full length of member 62. Bolts 70 with washers are threaded into the base 72 of the percussion instrument to fix the position of the pedal 10 relative to the base 72. The mechanism 50 can be mounted on either the right or left side of the base 72.

Figure 2:
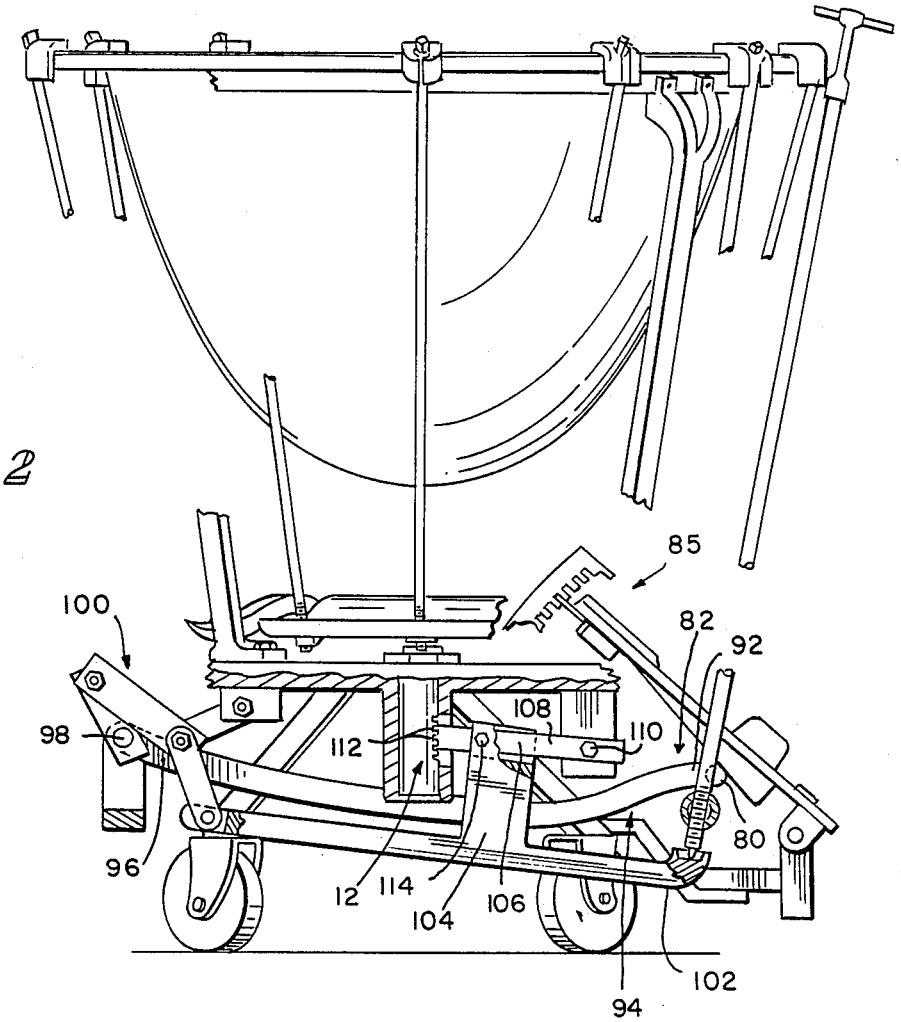
FIG. 2 is a fragmentary side elevational view showing certain details of the tuning mechanism of a kettledrum of the type described in the above-mentioned co-pending U.S. patent applications.

Pedal 10 includes a guide means in the form of a wedge or inclined plane 74 which is fixed to the bottom surface 76 of pedal 10. The wedge 74 includes a lower surface 78 which is inclined away from the bottom surface 76 of the pedal 10 toward the heel end 22 relative to the user-engageable surface 18 of the pedal 10. Wedge 74 thus provides an inclined surface on which a roller 80 (FIG. 2) of a variable tension exerting means 82 can roll. The roller 80 is generally similar to the rollers 232, 763 shown and described in our U.S. Ser. Nos. 617,747 and 667,217.

Spring 42 is provided for normally biasing a tooth 84 provided on the toe end 86 of lever 26 into engagement with a selected tooth of a position fixing means 85 (FIG. 2), which is similar to the position fixing means 426, 726 of our earlier filed applications.

Roller 80 is pivotally mounted on the end 92 of a lever arm 94. The other end 96 of lever arm 94 is fixed to a shaft 98 so that depression and releasing of the pedal 10 rotates the shaft 98. Shaft 98 works through a linkage 100 which includes crank arms similar to crank arms 252, 258, 272 and 276 of our earlier filed U.S. Ser. Nos. 617,747 and 667,217. Linkage 100 acts upon a transmission arm 102 similar in configuration to transmission arm 294 of U.S. Ser. Nos. 617,747 and 667,217. Transmission arm 102 includes a riser 104 which is slotted at 106 at its upper end to receive a pivotal mounting member 108. Member 108 is pivoted at 110 at one of its ends from the supporting framework of the instrument. Teeth 112 at the other end of member 108 engage complementary teeth of a piston, such as teeth 78 of piston 77 of U.S. Ser. Nos. 617,747 and 667,217. The intermediate region of member 108 is pivotally engaged in the slot 106 by a bolt 114. Levers 94, 108 and 102 thus constitute first, second and third levers, respectively.

The tuning indicator according to the present invention includes a Bowden cable or sheathed cable 116 (FIG. 1). The end 121 of the cable extends through a bore 123 extending from the back through to the front of member 52. The end 118 of cable sheath 120 is stopped by butting up against member 52. A bolt 125 is provided with two nuts 126, 127. A threaded bore 128 is provided in one of knuckles 56 to receive the threaded end of bolt 125. Nut 126 is backed up against the surface of knuckle 56 to lock bolt 125 against rotation in bore 128. The end 121 of the cable extends through a diametral bore 129 provided near the head 130 of bolt 125. Nut 127 is tightened against the end 121 of the cable to position it relative to the pedal 10.

At its upper end 140, the sheathed cable 116 is attached to a tuning gauge 142 (FIG. 3). Tuning gauge 142 includes an outer gauge housing portion 144 and an inner gauge housing portion 146. The inner gauge housing portion 146 includes a back wall 147 provided with an upper flange 148 which extends away from the back wall 147 and the outer gauge housing portion 144. The back wall 147 also includes toggle clamp mounting plate 150 spaced vertically below the flange 148 a distance slightly greater than the vertical depth of the counterhoop 152 of the drum. A toggle clamp 154 is mounted on the underside of mounting plate 150. The active clamping surface, or jaw, 156 of clamp 154 is provided by a generally flat rectangular clamp plate 160. The inner housing portion 146 also includes a bottom 162. The bottom 162 is provided with two spaced holes 164, 166.

The outer housing portion 144 includes continuously extending curved top 168, straight side 169 and straight bottom 170 walls which extend generally perpendicularly away from its outer wall 172. The walls 169 are spaced to receive the bottom 162 of inner housing portion 146 between them. The bottom wall 170 of outer housing portion 144 is provided with holes 174, 176 which are in alignment with holes 164, 166, respectively, when the gauge 142 is assembled. A threaded nut 178 is captured between bottom walls 162, 170 of the inner and outer housing portions 146, 144 in the assembled gauge. Nut 178 is positioned so that its threaded opening is aligned between the aligned holes 164, 174 or 166, 176 depending upon whether the gauge is to be mounted on the right-hand side or left-hand side of a drum. A hollow threaded shaft 177 is screwed onto nut 178 through the aligned openings 164, 174 or 166, 176.

A pivot pin 180 extends through either aligned openings 182, 184 or aligned openings 186, 188 in the outer and inner housing portions 142, 144, respectively, again, depending upon whether the gauge is to be mounted on the right- or left-hand side of the drum. The pin 180 has a head on one end and is threaded on the other end to receive a nut 190 to help secure the gauge in assembled configuration. A needle mechanism 192 provides a circular opening 194 which serves as a mounting point through which pin 180 extends, an indicator needle 196, and a crank arm 200. A spacer 201 is provided between wall 172 and mechanism 192. A similar spacer (not shown) may be provided between mechanism 192 and wall 147 if necessary. The crank arm 200 slidably receives a collar 202 which is fixed to the upper end 204 of cable 116. The collar 202 has transverse aligned passageways 206. The crank arm 200 has a series of passageways 208 spaced longitudinally along it. A cotter pin 210 can be inserted through selected aligned passageways 206, 208 and spread to change the mechanical advantage of the crank arm 200, thus changing the amount of indicator needle 196 movement per unit of pedal 10 movement.

The curved gauge face 212 on the upper surface of top wall 168 of the outer housing portion 144 is markable and eraseable, for example, with a grease pencil so that tuning marks can be placed on it for performance of a particular piece and then erased to be remarked subsequently for another performance.

This gauge construction permits the gauge to be used with different types of drums and to be moved from location to location on a drum.

If the sprocket-tuned embodiment of FIGS. 9–10 of U.S. Ser. No. 667,217 is employed, the cable-driven indicator mechanism can be driven directly from the spider 220, as illustrated in FIG. 4, by attaching the lower end 121 of cable 122 to one of the spokes 224 of the spider 220. Since turning of the tuning crank 228 results in motion of the spider 220 either up or down, this motion will be reflected in motion of the needle 196 (FIG. 3) across the gauge face 212.

One mechanism for doing this is illustrated in FIG. 4. A clamping member 230 includes a first portion 232 of somewhat crescent shape terminating at one end in a flat stop plate 234 provided with a hole 236 generally through its center. A mounting plate 238 provided on clamping member 230 adjacent to stop plate 234 extends perpendicular to stop plate 234. A toggle clamp 240 is mounted on mounting plate 238 so that a support strut of a tympano can be captured between the first portion 232 and the clamping jaw of toggle clamp 240. The hole 236 is large enough to permit the cable 122 to pass readily through it, but is not large enough to permit the sheath 120 to pass through it.

The lower end 121 of cable 122 is attached to one of spokes 224 by a bolt 246 provided with nuts 248, 250. A threaded bore 252 is provided in spoke 224 to receive the threaded end of bolt 246. Nut 248 is backed up against the surface of spoke 224 to lock bolt 246 against rotation in bore 252. The end 121 of cable 122 extends through a diametral bore 254 provided near the head 256 of bolt 246. Nut 250 is tightened against the end 121 of cable 122 to position it relative to spider 220.

A bracket 260 for attaching the lower end 121 of gauge cable 122 to an existing pedal mechanism is illustrated in FIG. 5.

The bracket 260 comprises a somewhat U-shaped channel section 262 having upstanding, generally parallel walls 264, 266 joined by a transversely extending web 268. A portion of wall 266 has been removed to define a notch 270. A toggle clamp 272 is mounted on the outside of the remaining portion of wall 266 so that the clamping jaw 274 of clamp 272 projects into the notch 270. A threaded hole 276 is provided in the web 268 to receive the threaded end of a bolt 278. Bolt 278 is provided with two nuts 280, 282. Nut 280 is backed up against web 268 to lock bolt 278 against rotation in hole 276. The end 121 of cable 122 extends through a diametral bore 284 provided near the head 286 of bolt 278. Nut 282 is tightened against the end 121 of the cable to position it relative to the bracket 260. The bracket 260 can then be clamped, using the toggle clamp 272, to, for example, the toe portion of a pedal of a tympano.

What is claimed is:

1. A percussion instrument comprising a body member, means for supporting the body member, a percussion head carried by the body member, tensioning rods, means for operatively coupling the tensioning rods to the percussion head, a master tensioning member for tensioning the percussion head, the master tensioning member having a central portion and radially outer portions, means for coupling the tensioning rods to the radially outer portions, means for mounting the master tensioning member for movement relative to the means for supporting the body member, and means for moving the master tensioning member relative to the body member to tune the tension on the portion of the percussion head stretched across the body member selectively, the means for moving the master tensioning member comprising a pedal, a first lever for engaging the pedal, a shaft, means for rotatably mounting the shaft on the means for supporting the body member, means for mounting the first lever to the shaft to turn the shaft in response to movement of the first lever, a second lever, means for pivotally mounting the second lever from the means for supporting the body member, the second lever including means for engaging the master tensioning member such that pivotal movement of the second lever moves the master tensioning member, a third lever, means for pivotally coupling the third lever to the second lever intermediate the ends of the second lever and intermediate the ends of the third lever, and a linkage for coupling the shaft to the third lever such that movement of the first lever causes a corresponding movement of the master tensioning member.

2. The invention of claim 1 and further comprising a tuning gauge comprising a gauge face and an indicator, means for relatively movably mounting the indicator and the gauge face, means for mounting the gauge on the percussion instrument, a sheathed cable, means for mounting a first end of the cable sheath stationarily relative to one of the gauge face and indicator, means for mounting the second end of the cable sheath stationarily relative to one of the master tensioning member and the means for supporting the body member, means for mounting the first end of the cable stationarily relative to the other of the gauge face and indicator, and means for mounting the second end of the cable stationarily relative to the other of the master tensioning member and the means for supporting the body member, relative movement of the master tensioning member and means for supporting the body member resulting in relative movement of the indicator and gauge face.

3. A percussion instrument comprising a body member, means for supporting the body member, a percussion head carried by the body member, tensioning rods, means for operatively coupling the tensioning rods to the percussion head, a master tensioning member for tensioning the percussion head, the master tensioning member having a central portion and radially outer portions, means for coupling the tensioning rods to the radially outer portions, means for mounting the master tensioning member for movement relative to the means for supporting the body member, and means for moving the master tensioning member relative to the means for supporting the body member to tune the tension on the portion of the percussion head stretched across the body member selectively, a tuning gauge comprising a gauge face and an indicator, means for relatively movably mounting the indicator and the guage face, a toggle clamp for selectively movably mounting one of the indicator and the gauge face on the percussion instrument, the toggle clamp including a first portion for relatively permanent fixed attachment to the one of the indicator and gauge face, first and second clamping jaws, and means for relatively movably mounting the first and second clamping jaws relative to each other upon the first portion, relative movement of the first and second clamping jaws to a clamping orientation permitting clamping of the tuning gauge on the percussion instrument while relative movement of the first and second clamping jaws to a release orientation permits removal of the tuning gauge from the percussion instrument, a sheathed cable, means for mounting a first end of the cable sheath stationarily relative to one of the gauge face and indicator, means for mounting the second end of the cable sheath stationarily relative to one of the master tensioning member and the means for supporting the body member, means for mounting the first end of the cable stationarily relative to the other of the gauge face and indicator, and means for mounting the second end of the cable stationarily relative to the other of the master tensioning member and the means for supporting the body member, relative movement of the master tensioning member and means for supporting the body member resulting in relative movement of the indicator and gauge face.

4. A percussion instrument comprising a body member, a percussion head carried by the body member, a variable tension-exerting means for exerting variable tension on the head to vary the pitch of sound produced when the head is struck, an actuating means for actuating the variable tension-exerting means, the actuating means comprising a pedal having a generally planar user-engageable top surface, a bottom surface on the side of the pedal opposite the top surface, the bottom surface including means providing a pivot, a lever pivotally mounted on the pivot, the lever including a portion extending toward a heel of the pedal and accessible by the foot of a user of the pedal along one side of the heel thereof while the user's foot is positioned on the top surface, the lever also including a portion extending to a toe of the pedal and providing an engaging means and a positioning means selectively engageable with the engaging means for fixing the position of the pedal.

* * * * *